United States Patent [19]

Brazell, II

[11] Patent Number: 4,759,412

[45] Date of Patent: Jul. 26, 1988

[54] ROCK BREAKING DEVICE

[76] Inventor: James W. Brazell, II, 455 Heards Ferry Rd., Atlanta, Ga. 30328

[21] Appl. No.: 920,771

[22] Filed: Oct. 20, 1986

[51] Int. Cl.[4] ..... E21B 7/02

[52] U.S. Cl. ..... 173/22; 173/55; 173/92; 173/114; 173/128

[58] Field of Search ..... 173/22, 23, 28, 55, 173/92, 112, 128, 24, 25, 26, 27, 53, 54, 56, 114

[56] References Cited

U.S. PATENT DOCUMENTS 3,713,498 1/1973 Watanabe et al. ..... 173/53

FOREIGN PATENT DOCUMENTS 996634 2/1983 U.S.S.R. ..... 173/92

1009751 4/1983 U.S.S.R. ..... 173/92

*Primary Examiner*—Timothy V. Eley

*Attorney, Agent, or Firm*—Hurt, Richardson, Garner, Todd & Cadenhead

[57] ABSTRACT

A rock breaking device adapted to be coupled to the lifting arms of a tractor or similar vehicle is disclosed, the device having an upstanding guide tube with a hammer, chisel, and anvil disposed therein. The hammer can be raised within the guide tube by frictional engagement with a drive member and is then allowed to fall by gravitational force to impact the chisel and/or the chisel and anvil, thereby driving the chisel into the surface to be broken. The device has a shock absorber to minimize the force of impact and as a safety feature, cannot be made operational until actually positioned on the surface to be broken.

14 Claims, 4 Drawing Sheets

ROCK BREAKING DEVICE

BACKGROUND OF THE INVENTION

1. Field of the Invention

The invention relates to a device for breaking up large rocks and similar materials, the device being designed for connection to a front end loader, bulldozer, three-point hitch tractor, or a similar vehicle.

2. Description of the Prior Art

In many instances, large rocks, boulders, cement slabs, and the like must be fractured either to facilitate their removal from a particular area, or to form a more manageable building material from the larger pieces. Rock breaking devices, an example of which is shown in U.S. Pat. No. 4,562,974 to Bezette, et al., generally operate with a hammer or a hammer and chisel-type arrangement. The Bezette, et al. apparatus has a winch which raises a striker block, the block then being allowed to fall by gravity to contact a tool head which has been positioned on the rock to be broken. A plurality of rubber rings surround the guide tube to absorb shocks generated by the rock-breaking operation. On-site use is also necessary in many cases, requiring portability along with the capacity to operate in the field, either as a self-contained unit or coupled to a vehicle or tractor and using the power systems thereof.

SUMMARY OF THE INVENTION

It is, therefore, one of principal objects of the present invention to provide a substantial degree of safety for the workers handling the rock breaking operation, the device being incapable of being cocked prior to its disposition in operative position.

Another object of the invention is to provide a rock breaking device which is easily coupled to a suitable vehicle or tractor for transport and for utilizing the power systems of the vehicle.

A further object of the present invention is to provide a rock breaking device which is durable to provide a long service life and in which the shock to the device and the operator from the rock breaking operation is absorbed and thereby minimized.

These and additional objects are attained by the present invention which relates to a rock breaking device having an upstanding guide means or tube adapted to be carried or positioned vertically by a powered vehicle and having a cage means disposed therein. The cage means includes an anvil disposed below the guide means, a head member disposed above the guide means, and connection means extending therebetween and securing the anvil and head member together. A tool is secured within the anvil for positioning over the working area and a hammer means is positioned within the cage. The hammer is engageable by a drive means to elevate the hammer, whereupon it is disengaged and allowed to fall against the tool, thereby driving the tool against the rock or other surface. Shock absorbing means are provided for diminishing the vibrations and other shocks from the rock breaking operation.

The present device is designed to normally be coupled to a tractor, front end loader, bulldozer, or other similar and suitable vehicle, the device requiring a source of electrical power and preferably a vehicular hydraulic system with which the device may be coupled. The power source and hydraulic system may also, however, be provided separately.

Various additional objects and advantages of the present invention will become apparent from the below description, with reference to the accompanying drawings.

DETAILED DESCRIPTION OF THE PREFERRED EMBODIMENT

Figure 1:
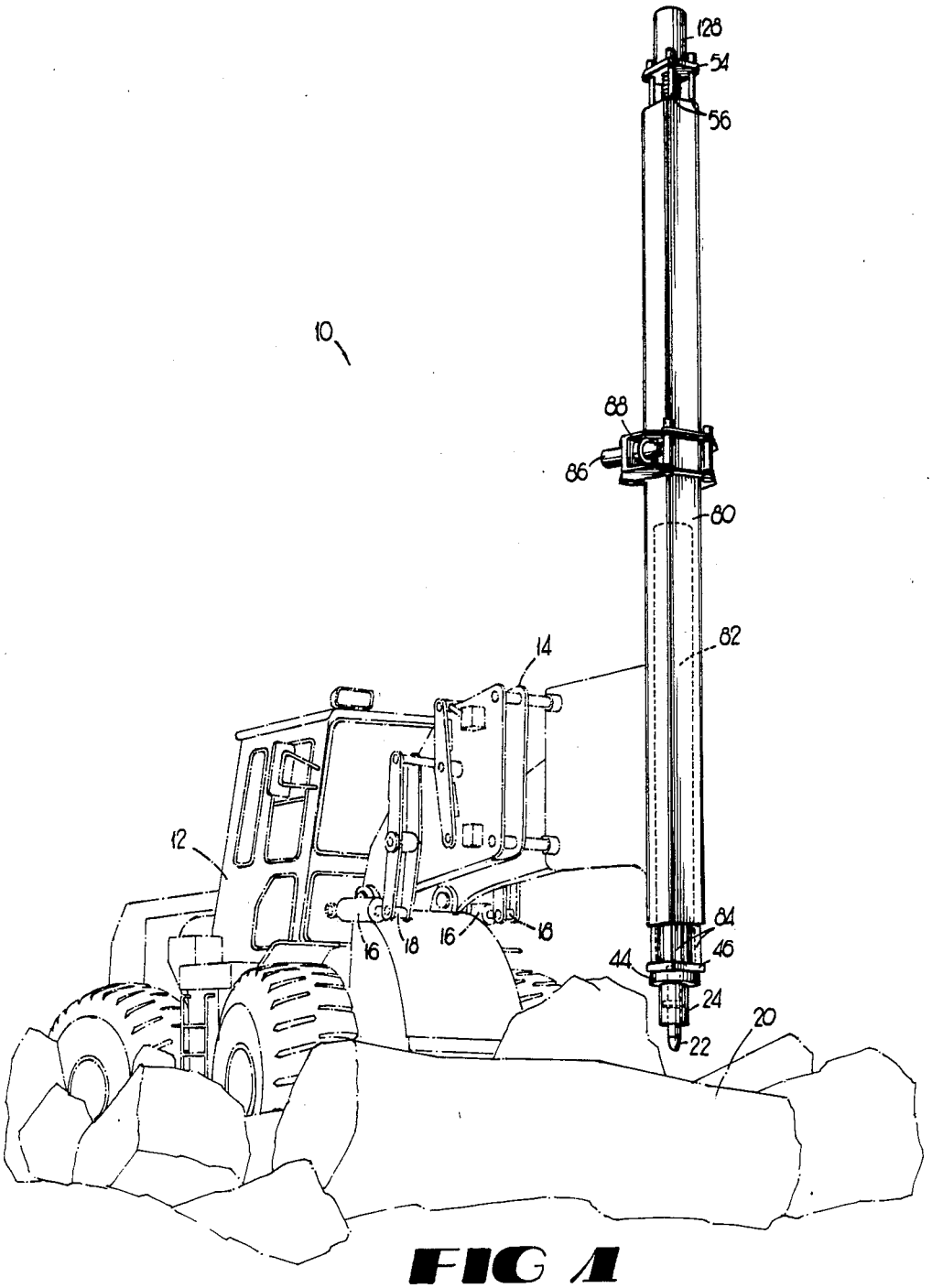
FIG. 1 is a perspective view of the present rock breaking device, shown here coupled to a front end loader as an example of a vehicle to which the present device may be attached.

Referring now more specifically to the drawings, and to FIG. 1 in particular, numeral 10 designates generally the rock breaking device, shown here coupled to a front end loader 12, the loader being shown in broken lines. The present device may be coupled to any of a number of suitable vehicles, such as front end loaders, bulldozers, tractors and the like, the device having electrical and hydraulic requirements for which the electrical and hydraulic systems of the vehicle are conveniently used.

Of course, other provisions can be made for the power requirements, if necessary. With the attachment to the vehicle, the present device may be transported to remote areas, over large obstacles, etc., without difficulty.

In coupling the present device to the front end loader shown, the bucket is first removed from the lifting arms, thereby exposing the points of connection. A suitable coupling means 14, shown in broken lines in FIG. 1, serves as an interface between the vehicle and the rock breaking device 10, it being understood that the coupling means may vary according to the type of vehicle. Normally, the bucket or the blade of the bulldozer is secured to the lifting arms 16 with pins 18. Thus, by removing the pins, and with a suitable interface in place, the normal tool implement may be removed and the present device easily substituted therefor. The interface 14 may be secured to the rock breaking device in any suitable manner, such as with pins or bolts (not shown).

An important feature of the present device is that it cannot be made operational, or "cocked", until it is placed in position over the working surface 20, or rock to be broken. Thus, the hammer cannot be raised when the device is in transit for positioning or otherwise, as shown in FIG. 1. In FIG. 1, the tool or chisel 22 is shown fully extended in a downward position, also indicated by the broken line in FIG. 2 which projects downwardly into rock 20. The broken line indicates the fully extended position of the chisel, which may be attained during operation depending on the rock or surface being broken; however, it should be understood that the chisel may not always reach the fully extended position, thus, the broken line is merely an indication of the maximum extension possible.

Figure 3:
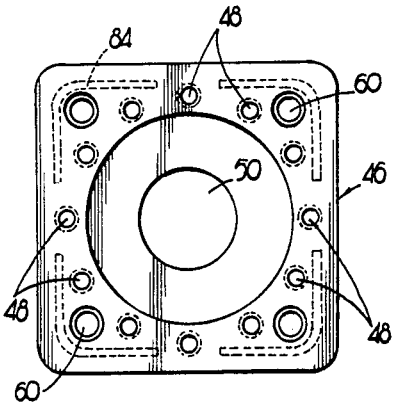
FIG. 3 is a top plan view of a portion of the anvil.

The chisel is retained within a holding means such as housing 24 having a lower limit defined by a ledge or abutment means 26. During operation, the ledge engages a collar means 28, formed around the chisel, serving to limit the downward movement of the chisel and to retain the chisel therein. The upper end 30 of the housing 24 is flared outwardly and wedgingly engaged by a collar 40. Disposed above collar 40 and secured thereto in a suitable manner, as with bolts 42 and nuts 44, is an anvil means 46, shown separately in FIG. 3.

The bolts and nuts 42 and 44, respectively, are disposed through holes 48 in the anvil 46, corresponding holes (not shown) being formed in collar 40. The anvil has a central passageway 50 formed therethrough, sized to accept the head end 52 of the chisel, the edges of the passageway serving as an abutment means against which the collar 28 of the chisel bears to limit the upward movement of the chisel.

Figure 5:
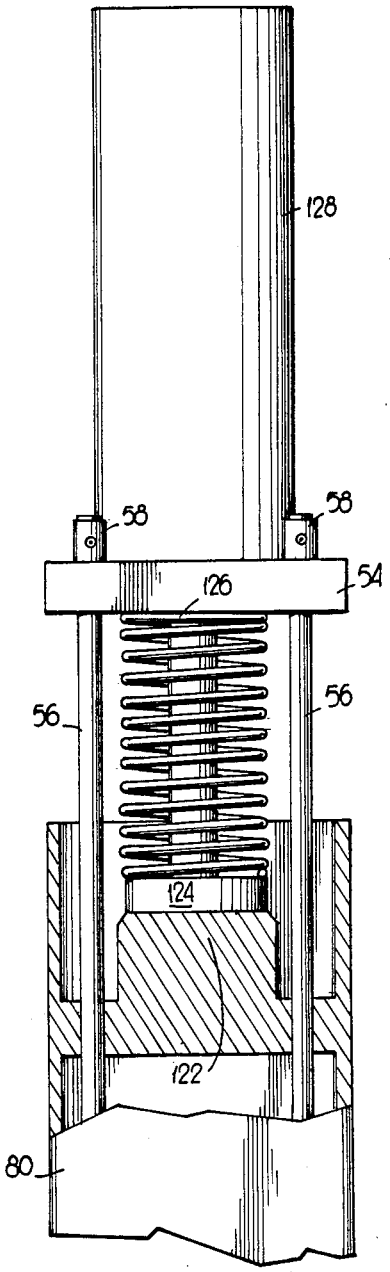
FIG. 5 is fragmentary, side elevational view, shown partially in cross section, of the upper portion of the device.

The anvil is connected to an upper plate member 54 through a plurality of rod means such as tie rods 56. The device shown includes four tie rods; however, this number may vary. The tie rods are secured to the anvil and plate using a suitable securing means such as the collars 58 shown in FIGS. 3 and 5, respectively. The tie rods are disposed for the most part inside an upstanding guide tube 80 and, together with plate 54 and anvil 46, effectively form an isolated cage structure therein.

Within this cage structure is disposed an elongated hammer means 82, shown as being generally circular, although a squared or rectangular configuration may be used, the only limitation being the dimenions defined by the cage structure. The hammer may be formed from any suitable material, such as steel or iron, and has substantial weight for accomplishing its rock-breaking purpose.

Figure 6:
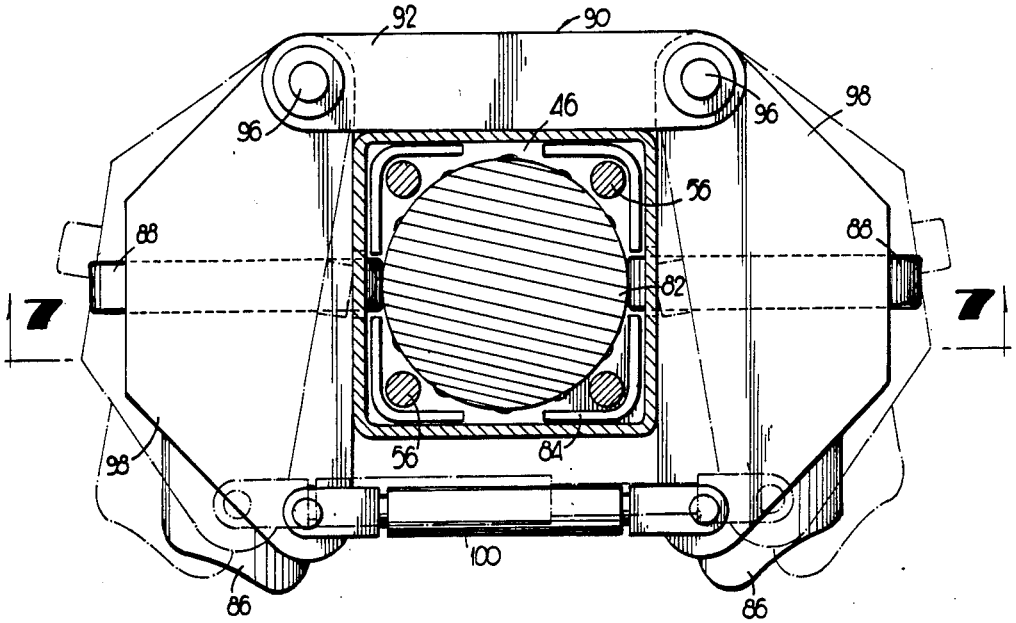
FIG. 6 is a cross sectional view showing the drive means engaging the hammer, the section being taken on line 6—6 of FIG. 4.

FIG. 6 illustrates the containment of hammer 82 by the tie rods 56 and also the containment of the tie rods by corner plates 84. These corner plates extend upwardly from the anvil to a position just above the level of the power means for raising the hammer. Thus, the hammer is substantially encompassed throughout its length of travel, helping to ensure safety and smooth operation.

Figure 4:
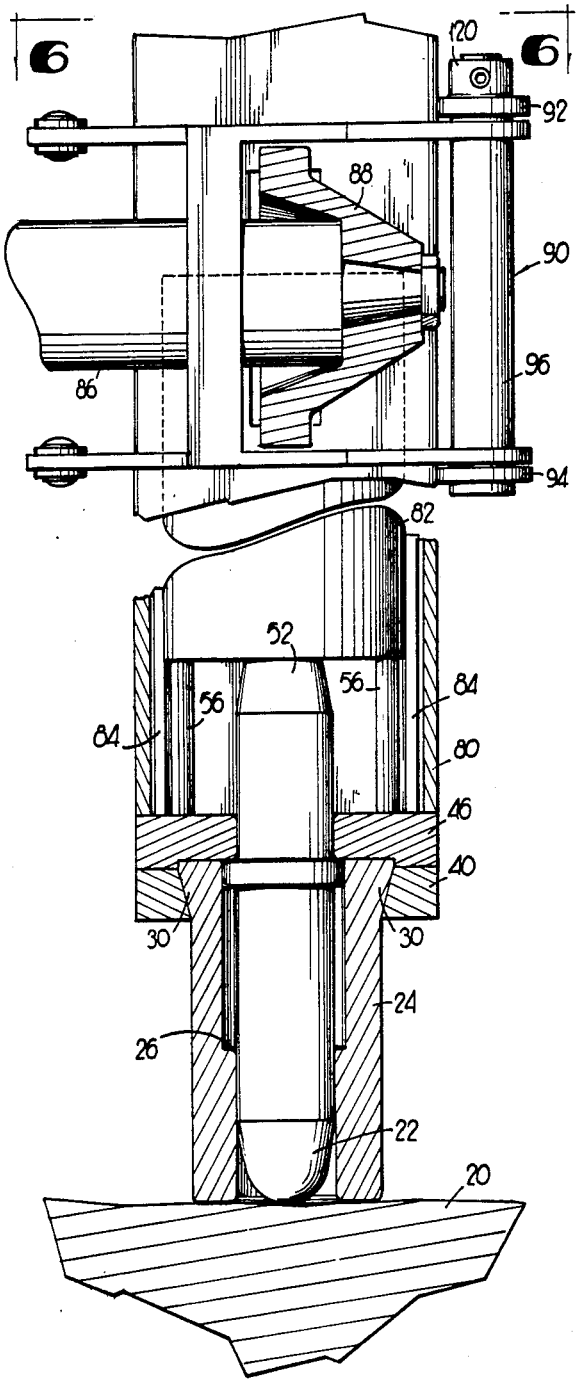
FIG. 4 is a fragmentary, side elevational view, shown partially in cross section, of the lower portion of the device, here being shown in a cocked position.
Figure 7:
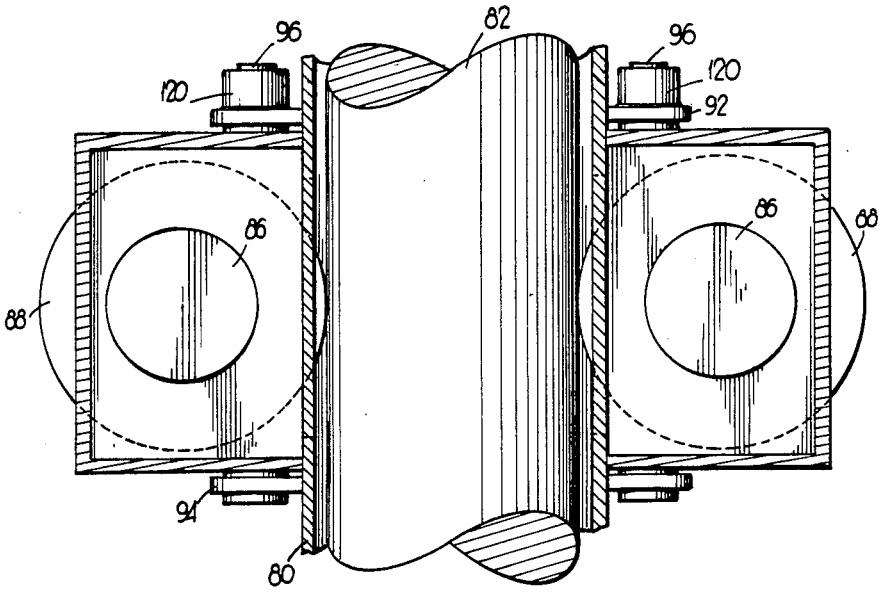
FIG. 7 is a cross sectional view also showing the drive means engaging the hammer, the section being taken on line 7—7 of FIG. 6.

The power means for raising the hammer include a motor or motors 86, one or more motors being usable, depending on various factors, such as horsepower, the load to be moved, and the ease or lack of same in coupling one motor to two drive wheels. In the embodiment shown, two opposed motors are used, each powering a drive wheel 88. The motors are pivotally mounted on a bracket means 90 which substantially surrounds the guide tube 80, and has a fixed end and an expandable end. The bracket means is best shown in FIGS. 4, 6 and 7 and includes upper and lower fixed back plates 92 and 94, respectively, the plates being fixedly secured to one another near each and thereof with generally vertical bars or supports 96. Connected for pivotal movement on supports 96 are bracket members 98 which hold the motors and have open center portions through which the wheels 88 may protrude. The guide tube 80 is also provided with openings at this level for the protrusion of the wheels therethrough. The inner faces of the bracket members conform substantially to the outer wall of the guide tube, thus, in the embodiment shown, they are substantially straight so as to be able to dispose the wheels in operative relationship with the hammer.

The front ends of the bracket members are secured together with a suitable actuating means such as hydraulic actuator 100, which is pivotally secured and axially expandable to cause the front ends of the bracket members to move toward or away from one another, thereby actuating or disengaging the drive means from the hammer. The movement of the bracket members, as controlled by the operator of the vehicle or device through the hydraulic actuator 100, are shown by the full and broken lines in FIG. 6, the broken lines illustrating the position of the members when disengaged from the operative position. The bracket members and back plates are secured to supports 96 in any suitable manner, such as with the collars 120 shown here, or with, for example, tapered bushings, to prevent their accidental disengagement from the supports.

Figure 2:
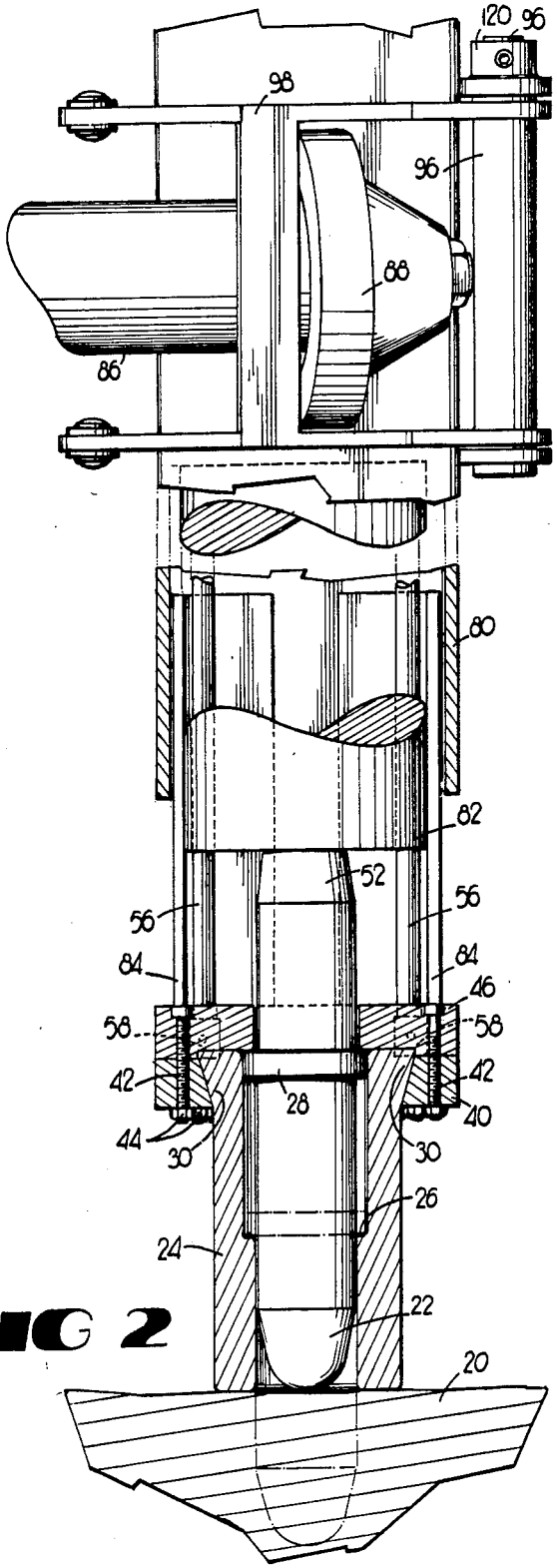
FIG. 2 is a fragmentary side elevational view, shown partially in cross section, of the lower portion of the present device.

As noted earlier, the present device cannot be made operational until placed in a working position on a rock or other surface to be broken. The non-operational positions of the hammer (in broken lines) and the chisel are shown in FIG. 1. When in position for working, as shown in FIGS. 2 and 4, the device is positioned over the surface to be broken, and the arms of the tractor are used to lower the device. The free-floating chisel, with the hammer resting thereupon, is forced upwardly in the guide tube, thereby raising the hammer to the position shown by the upper broken lines in FIG. 4, where it can be engaged by the wheels 88.

At this point, the hydraulic actuator 100 is operated through the control circuitry of the tractor to close the bracket members, thereby selectively frictionally engaging the hammer with the drive wheels. Upon activation of the motor or motors through the control circuitry of the tractor, the wheels raise the hammer to the position shown in FIG. 5, the upper end of the hammer being near the upper end of the guide tube. When the hammer has reached its full elevation, the hydraulic actuator is used to open the bracket members, thereby disengaging the wheels from the hammer and allowing it to fall by its own weight under the force of gravity. As the hammer impacts the chisel, the chisel is driven downwardly into the surface to be broken, the downward stroke of the hammer being limited by its potential engagement with the anvil 46, and the engagement of the collar 28 around the chisel with the ledge or abutment 26 in chisel housing 24.

In many situations, the chisel will not be driven to its lowest point; however, any downward movement of the chisel is sufficient to prevent the wheels from engaging the hammer the operator has re-positioned the device. Should the hammer reach the anvil on its downward stroke, the force is absorbed by a shock absorbing means, provided at the upper end of the guide tube.

As noted, the anvil 46 is connected to an upper plate 54 through the tie rods 56. In the upper end of the guide tube, a platform means 122 is provided, upon which the shock absorbing means rests. The shock absorbing means includes a lower holding means or keeper 124, which supports a suitable resilient means, such as spring 126. The upper end of the spring abuts the upper plate 54. Thus, any force transmitted through the tie rods to the upper plate is absorbed by the spring and substantially prevented from being transmitted through the device to the tractor and its operator. Disposed above the upper plate 54 is a pipe 128 or other suitable means, plate 54 being axially movable thereon for absorbing any rebound from the hammer stroke contacting the anvil.

The use and operation of the present rock breaking apparatus can be seen in the drawings viewed sequentially from FIG. 1 to FIG. 4. FIG. 1 illustrates the uncocked position from which the hammer 82 cannot be raised. When in position over a rock 20 or other surface to be broken, the device is lowered by the arms 16 of the tractor 12, the chisel housing 24 resting on the rock and the free floating chisel 22 and hammer 82 being pushed upwardly as the device is lowered. Upon reaching the position shown in FIG. 4, the hammer is at a level where it can be engaged by the drive wheels 88 and raised to its full height.

At full elevation, the hydraulic actuating means 100 is used to spread apart the motor holding brackets 98, thereby disengaging the drive wheels from the hammer and allowing it to fall. The hammer drives the chisel downwardly into the rock or other material, and the shock or vibration from the blow is absorbed by a resilient shock absorbing means disposed at the top of the guide tube. Thus, a very efficient, safe, and shock resistant apparatus is presented, which may be coupled with a plurality of suitable vehicles depending on terrain, distance, and other factors, and which is substantially resistant to wear in a normally severe service environment.

While an embodiment of a rock breaking device has been shown and described in detail herein, various changes and modifications may be made without departing from the scope of the present invention.

I claim:

1. A rock breaking device for connecting through an interface to the lifting arms of a vehicle, said device comprising an upstanding guide tube means having a chisel means protruding from the bottom end of said tube means, an anvil means secured around said chisel means and having an aperture formed therein through which a portion of said chisel protrudes upwardly, hammer means disposed in said tube means above said chisel means and adapted for vertical movement therein, drive means for selectively frictionally engaging said hammer means for raising said hammer means in said tube means, power means for selectively activating said drive means, an upper plate member disposed above said guide tube means, rod means connected to and extending between said upper plate member and said anvil for forming a cage, and a shock absorbing means operatively connected to said anvil means.

2. A rock breaking device as defined in claim 1 in which said drive means has engaged and disengaged positions, and said power means moves said drive means away from said hammer means when in said disengaged position.

3. A rock breaking device as defined in claim 1 wherein said drive means for selectively frictionally engaging said hammer means is capable of such frictional engagement when said chisel means is positioned on rock or other hard solid substance and said lifting arms are disposed in a lowered position.

4. A rock breaking device comprising an upstanding guide tube means having a chisel means disposed at the lower end thereof for breaking rocks, a hammer means disposed above said chisel means in said guide tube and being axially movable therein, a motor and drive means for selectively engaging and disengaging said hammer means for raising said hammer means and allowing said hammer means to fall under gravitational force, respectively, for impacting said chisel means, said drive means being pivotally mounted in said guide tube means and having means for frictionally engaging said hammer means for raising said hammer means, and a power means for activating said motor and drive means.

5. A rock breaking device as defined in claim 4 in which said device includes an interface for connecting said device to a vehicle having lifting arms.

6. A rock breaking device as defined in claim 5 in which said interface is secured to said guide tube means and to said lifting arms of said vehicle.

7. A rock breaking device as defined in claim 4 in which said device includes a shock absorbing means operatively connected to said anvil means.

8. A rock breaking device as defined in claim 4 wherein said device engages rock or other hard solid substances wherein said drive means frictionally engages and raises said hammer means when said chisel means is positioned to rest on rock or other hard solid substance.

9. A rock breaking device designed to be coupled to a suitable vehicle, said vehicle having lifting arms, said device comprising an upstanding guide tube means having an interface connected thereto, said interface being connected to said lifting arms of said vehicle for coupling said device to the vehicle, a chisel means captured in the lower end of said guide tube means and being axially movable therein for engaging rock or other hard solid substances such as cement or asphalt, a hammer means disposed in said guide tube means above said chisel means and being axially movable therein, drive means for selectively frictionally engaging said hammer means for raising said hammer means in said guide tube means, an anvil means secured at the lower end of said guide tube means for receiving said chisel means, an upper plate member disposed above said guide tube means, rod means connected to and extending between said upper plate member and said anvil means for forming a cage around said hammer, and a power means for selectively activating and deactivating said drive means

10. A rock breaking device as defined in claim 9 in which said drive means has engaged and disengaged positions, and said power means moves said drive means away from said hammer means when in said disengaged position.

11. A rock breaking device as defined in claim 9 in which said drive means are pivotally mounted on said guide tube means and said guide tube means have at least one aperture formed therein for receiving said drive means therethrough.

12. A rock breaking device as in claim 9 wherein said drive means engages and raises said hammer means when said chisel means is positioned at rest on top of said rock or other hard solid substances such as cement or asphalt.

13. A rock breaking device comprising an upstanding guide tube means, an anvil means disposed at the lower end of said guide tube means and having a chisel means disposed therein for breaking rocks, a hammer means disposed above said chisel means in said guide tube and being axially movable therein, a motor and drive means pivotally mounted on said guide tube means, said guide tube means having apertures formed therein for receiving said drive means therethrough for selectively engaging and disengaging said hammer means and raising said hammer means and allowing said hammer means to fall under gravitational force, respectively, for impacting said chisel means, a power means for activating said motor and drive means, an upper plate member disposed above said guide tube means with a rod connected to and extending between said upper plate member and said anvil means for forming a cage around said hammer, and a shock absorbing means operatively connected to said anvil means.

14. A rock breaking device as in claim 13 wherein said drive means frictionally engages and raises said hammer means when said chisel means is positioned to rest or rock or other hard solid substance.

* * * * *